US005632105A

United States Patent [19]

Bonaventure

[11] Patent Number: 5,632,105

[45] Date of Patent: May 27, 1997

[54] SKI BOOT INCORPORATING ADAPTABLE UPPER

[75] Inventor: Laurent Bonaventure, Cran-Gevrier, France

[73] Assignee: Salomon S.A., Annecy, France

[21] Appl. No.: 594,657

[22] Filed: Feb. 2, 1996

[51] Int. Cl.[6] ..... A43B 5/04

[52] U.S. Cl. ..... 36/117.1; 36/117.6; 36/117.7; 36/117.8; 36/117.9

[58] Field of Search ..... 36/117.1, 117.6, 36/117.7, 117.8, 117.9

[56] References Cited

U.S. PATENT DOCUMENTS

| | | | |
|---|---|---|---|
| 3,599,351 | 8/1971 | Check | 36/117.9 |
| 3,710,484 | 1/1973 | Heitzinger | 36/117.1 |
| 3,729,841 | 5/1973 | Wagner | 36/117.1 |
| 5,046,268 | 9/1991 | Munari | 36/117.8 |
| 5,425,187 | 6/1995 | Artusi et al. | 36/117.1 |
| 5,490,337 | 2/1996 | Zerbinati | 36/117.7 |
| 5,553,402 | 9/1996 | Marega et al. | 36/117.7 |

FOREIGN PATENT DOCUMENTS

| | | | |
|---|---|---|---|
| 317764 | 5/1989 | European Pat. Off. | 36/117.1 |
| 0468171A1 | 1/1992 | European Pat. Off. . | |
| 0467142A1 | 1/1992 | European Pat. Off. . | |
| 2639800A1 | 6/1990 | France . | |

*Primary Examiner*—M. D. Patterson
*Attorney, Agent, or Firm*—Pollock, Vande Sande & Priddy

[57] ABSTRACT

Sport boot incorporating a shell base (1) surmounted by an upper (2) adjustable on the wearer's lower leg and comprising an immobilization device (4) functioning in and in relation to the upper (2). The immobilization device (4) comprises a rotating shim (6) on a pin (7), this shim extending on the inner wall (16) of the upper (2) and in proximity to the upper edge (12) thereof. The shim (6) is provided with a projection (8) which, depending on the angular position thereof, retracts into a recess (14) in the upper (2) or protrudes onto the wall (16) of the latter. The immobilization device (4) makes possible the effective adaptation of the upper (2) to the morphology of the wearer's lower leg.

8 Claims, 4 Drawing Sheets

SKI BOOT INCORPORATING ADAPTABLE UPPER

FIELD OF THE INVENTION

The invention relates to sport boots incorporating a shell surmounted by a high upper and made adjustable on the lower leg of the user by means of tightening devices, and it concerns a device designed to immobilize the lower leg in place in and in relation to said upper.

BACKGROUND OF THE INVENTION

There exist numerous lower leg-immobilization devices, especially in alpine ski boots. These devices normally function either by means of the insertion of relatively thick removable shims between the upper and the lower leg, by changing the position of immobilizing elements permanently connected to the upper, or by modifying the length of one portion of the periphery of the upper, other than that part used for tightening adjustment.

These immobilizing devices prove indispensable, most often for proper adaptation to the morphology of the rear part of the lower leg, in particular in order to take into account variations of thickness of the calves and the position of the calves in relation to the height of the boot upper. These adjustment devices are also used to change the rearward support position of the lower leg in relation to the upper. When used in this way, the angled position of the median longitudinal axis of the lower leg changes in consequence in relation to the shell base of the boot, with respect to a given angled position of the longitudinal axis of this upper. In fact, the immobilizing devices thus used produce what is commonly termed adjustment of forward attitude.

As an example, mention may be made of Japanese Model of Utility No. 40-6561, which discloses a device incorporating a removable, reversible shim; of Swiss Patent No. 677 589 and French Patent No. 2,639,800, which describe devices in which the position of the adjustment elements can be changed, and French Patent Application No. 2 276 850, which relates to a shim designed to modify the length of one portion of the periphery of the upper, other than the tightening-adjustment portion.

These devices allow the lower leg to be secured in place; however, they pose a number of problems. In fact, in the examples of the removable shim and of the shim designed to modify a portion of the periphery of the upper, the shims in question must be detached in order to make the adjustment. This operation is difficult to perform outside of a sheltered area, since it requires that the top of the upper be released, or even that the boot be removed, and thus cannot be carried out correctly on ski runs, much less in snow. In addition, because the skims have to be dismantled, there is the additional risk of dropping them during the procedure, and, if not of losing them, of requiring a search and/or cleaning to ensure that they remain free of any dirt. In the case of devices whose immobilizing components can be changed while they are in position, the risk of loss of these components is not a factor; on the other hand, it is essential to have suitable tools for performing the operation properly, and also for releasing the top of the upper. It is obvious, moreover, that these devices have relatively complex structures, since they employ mobile metal parts that are movable translationally and reciprocally adjusted, for example using screw-nut assemblies. Such structures thus must be protected against infiltrations of snow, water, mud, etc., to prevent the soiling and/or deterioration of the metal parts composing them and to ensure that they remain easily maneuverable.

SUMMARY OF THE INVENTION

The present invention proposes to solve these problems by utilizing a simple immobilizing device fixed in position on the boot upper, which thus cannot be lost is maneuverable without requiring even partial dismantling, which does not require any tools or special protection to be usable, in particular on ski runs and/or in snow, and which is impervious to dirt accumulation.

To this end, the sport boot whose shell base is surmounted by an high upper adjustable over the lower leg of the wearer using tightening devices and incorporating a device for immobilizing the lower leg in and in relation to this upper, by being interposed between the upper and the lower leg in proximity to the upper edge of the upper, is characterized by the fact that adjustment device comprises a rotating shim which, fastened to the upper by means of a rotating and connecting pin, extends at partially on the inner wall of the upper and can be adjusted angularly in at least two immobilization positions, one position corresponding to a maximum immobilization position and a position corresponding to minimum immobilization. The immobilization device is characterized by the fact that the rotating shim is provided with a projection which protrudes against the inner wall of the upper in the maximum angled immobilization position, in which the shim is positioned at a distance from the inner wall of the upper and thus drawn closer to the lower leg of the wearer, and which retracts into a corresponding recess in the upper in the minimum angled immobilization position, in which the shim is pressed against the inner wall of the upper and thus moves away from the lower leg.

The contour of the shim is determined in relation to the upper edge of the upper, taking into account the position of its connection and rotational pin on the upper, so that, in the minimum angled immobilization position at least, its edge does not extend beyond the upper edge of the upper. In addition, the projection on this shim is located on the latter so as to take into account the upper edge of the upper and of the axis of rotation of the shim, so that, in the maximum angled immobilization position, the projection protrudes against the inner wall of the upper in proximity to the upper edge of the latter. Advantageously, the projection is elongated and extends substantially parallel to the upper edge of the upper in the maximum angled immobilization position of the shim.

The shim is fitted with a maneuvering mechanism that can preferably be grasped manually and is accessible from the outside of the boot upper in at least the two angled immobilization positions. Accordingly, the wearer can easily place the rotating shim in either of the angled immobilization positions without dismantling the assembly; that is, the wearer can make the immobilization adjustment operative or inoperative in the area in which the shim is mounted.

In order to match as closely as possible the contour of the inner surface of the upper, the shim is produced as a plate made of a relatively flexible material. Thus, the shim provides for the continuity of the enclosing surface of the upper, whatever the angled position thereof. Moreover, when its projection is placed in the corresponding recess produced in the upper, it remains elastically in place in this angled position.

According to an embodiment utilizing this flexibility of the plate constituting the shim, a "boss-recess" interlocking system is produced between the inner wall of the upper and the projection provided on the shim. Thus, the shim is also held elastically in the other angled immobilization position, in which the projection thereof protrudes onto the inner wall of the upper.

According to various embodiments, the adjustment device is adapted to different types of boots, e.g., front-entry, center-entry, mixed, or rear-entry boots known in alpine skiing.

Furthermore, the adjustment device is positioned and attached to the boot upper either on the rear part, a lateral portion, or the front part of the upper, depending on the desired immobilization adjustment. To this end, the rotating shim belonging to the immobilization device is preferably removably attached to the upper. For example, its rotating connection pin can be made detachable. In this way, it is possible to mount the device as desired in one of several attachment positions provided on the upper, depending on the lower leg immobilization adjustment contemplated. Secondarily, this removable attachment provides for easy replacement of the rotating shim for aesthetic reasons, in particular to match colors, or for technical reasons relating to the desired range of immobilization adjustment control, to stiffness, etc.

According to a variant, the rotating shim is a flexible plate incorporating an extension, or tongue, which extends along the skier's lower leg appreciably beyond the projection, and which, when the shim is placed in the maximum angled immobilization position, extends beyond the upper edge of the boot upper. This extension thus reinforces support of the lower leg, which is placed in the active position simultaneously with placement in the maximum immobilization position.

BRIEF DESCRIPTION OF THE DRAWINGS

The invention will be better understood by referring to the following description supplied with reference to the attached drawings illustrating, by virtue of example, an embodiment of the adjustment device and various possible applications.

DETAILED DESCRIPTION

Figure 1:
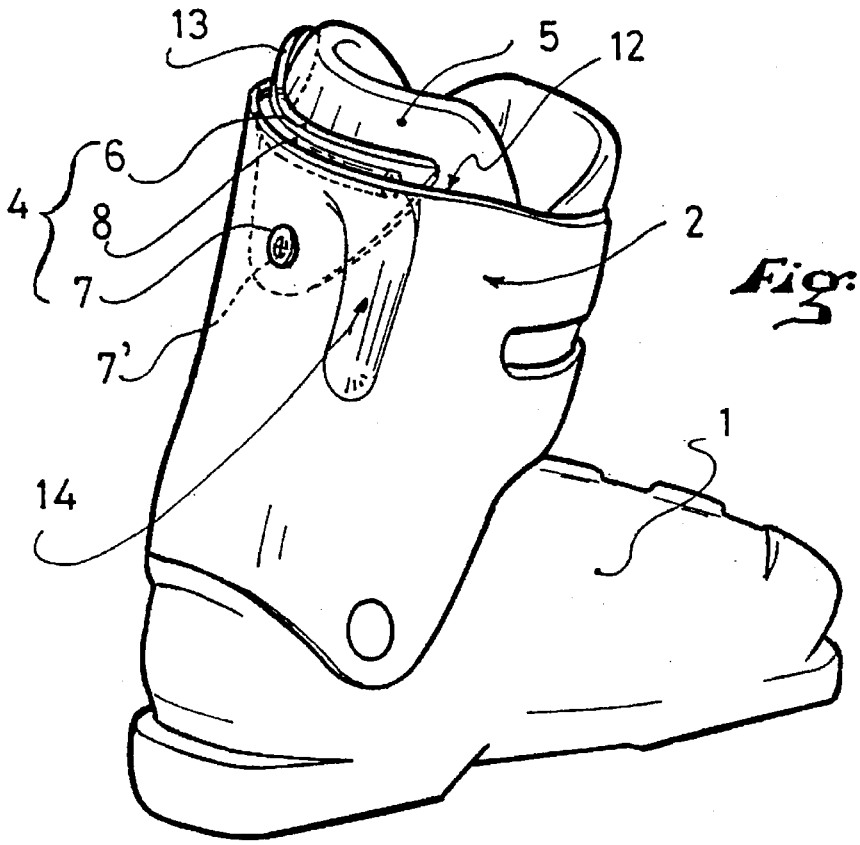
FIG. 1 is a perspective view of a ski boot in which the high upper is provided with an adjustment device according to the invention, which is placed in the maximum angled immobilization position.
Figure 2:
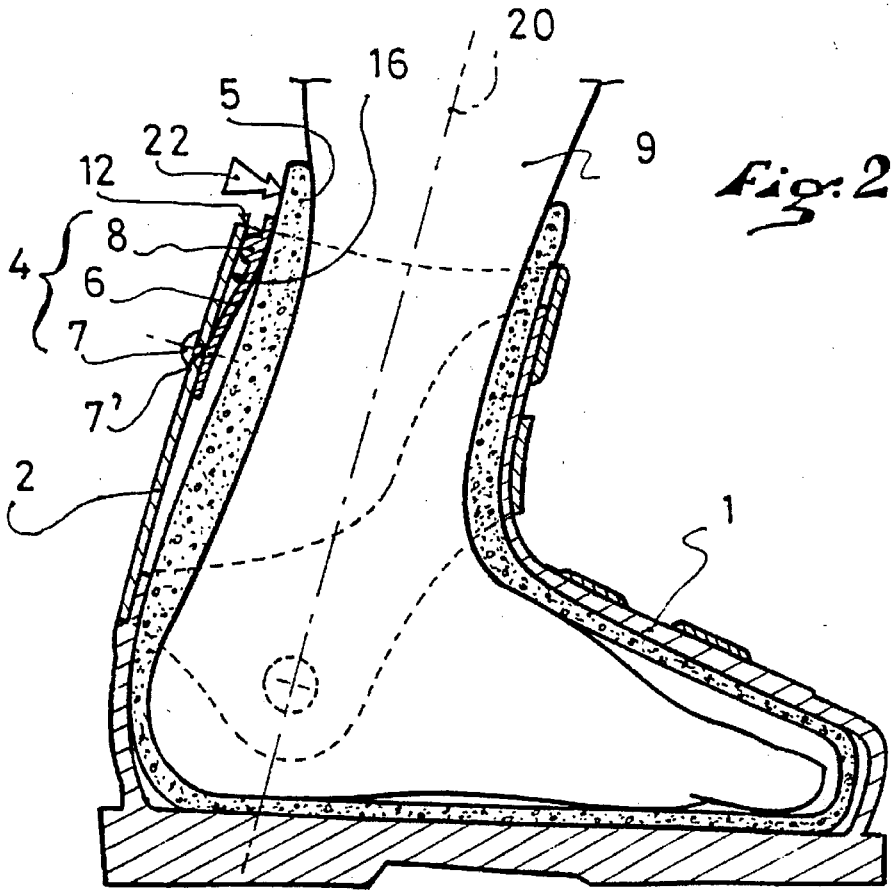
FIG. 2 is a longitudinal cross-section of the boot in FIG. 1.
Figure 5:
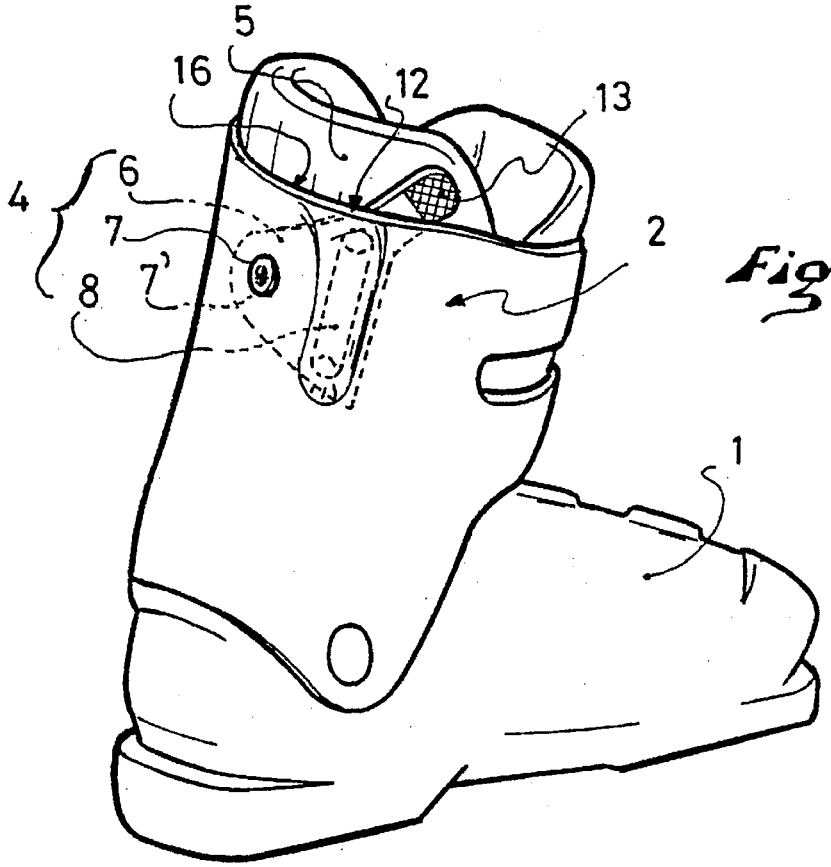
FIGS. 5, 6, 7, and 8 illustrate the same ski boot as that in FIG. 1, but in which the immobilization device is placed in the minimum angled immobilization position.
Figure 6:
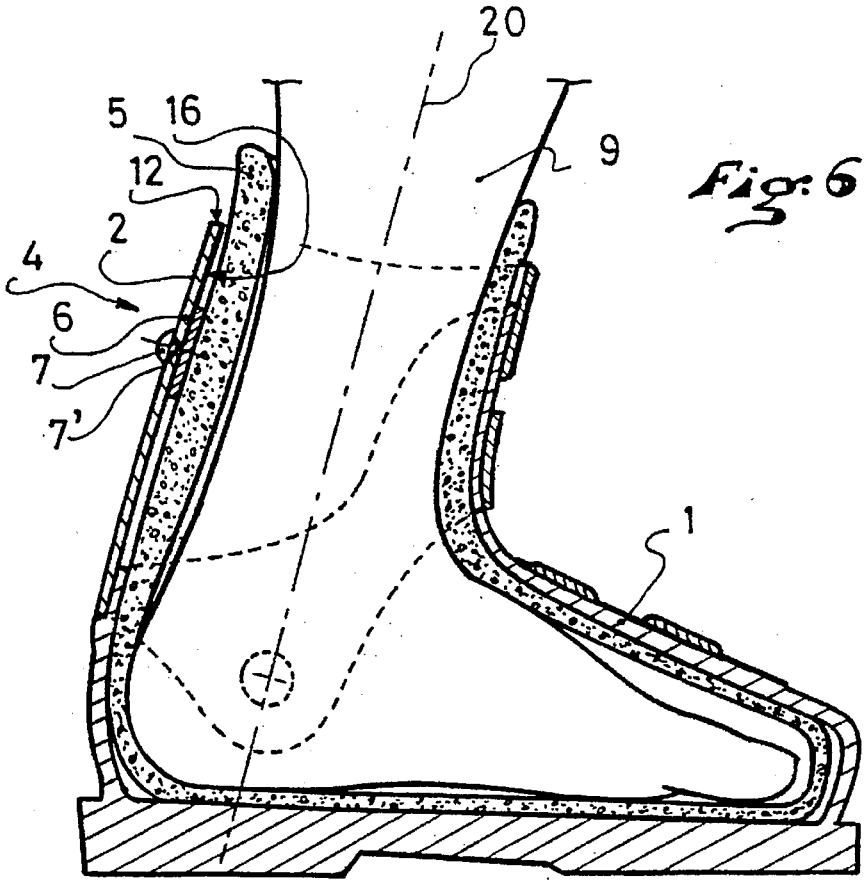

The high upper sport boot shown in FIGS. 1 to 8 is an alpine ski boot. This boot comprises a shell base 1 surmounted by an upper 2 made adjustable on the skier's lower leg using conventional tightening devices (not shown), which act on the rear portion of the lower leg 9, and this boot incorporates a device 4 for immobilizing the lower leg in and in relation to the upper 2. This immobilization device 4 extends on the inner wall 16 of the upper 2 and in the upper area of the latter, and it fits between the upper and the lower leg 9 covered with the interposed comfort sock 5. This device comprises a relatively flat, thin rotating shim 6, which is held in place on the upper 2 by means of a rotating connection pin 7 mounted on a point of attachment 7' and which is provided with a projection 8 positioned at a determinate distance from this pin 7. This projection may incorporate any contour whatever; for example, in the case shown, a semi-circular profile as shown schematically and bearing reference number 8'. The projection 8 cooperates with the inner wall 16 of the upper 2, so as to either protrude or be retracted in relation to this wall, depending on the desired immobilization adjustment. To this end, the upper 2 incorporates a recess 14 corresponding to the projection 8 and positioned at the same distance from the rotating pin 7 as that of the projection 8. The recess 14 is, moreover, angularly offset from the upper edge 12 of the upper 2 by an angle corresponding to the angle of rotation of the shim 6 between the two adjustment positions thereof, and in the example shown by approximately 90°. Thus, in one angled position of the shim 6 as illustrated in FIGS. 5 to 8, the projection 8 retracts into the recess 14; while, in another angled position, such as that illustrated in FIGS. 1 to 4, the projection 8 protrudes against the inner wall 16 of the upper 2. As a result of these two relative positions of the projection 8 in relation to the inner wall 16 and without changing the tightening adjustment of the upper 2, immobilization adjustment is maximal when the projection 8 protrudes, since the shim 6 is drawn away from the wall 16 and closer to the lower leg 9, and is minimal when the projection 8 retracts into the recess 16, since the shim 6 is pressed against the wall 16 and thus is drawn away from the lower leg 9.

Figure 4:
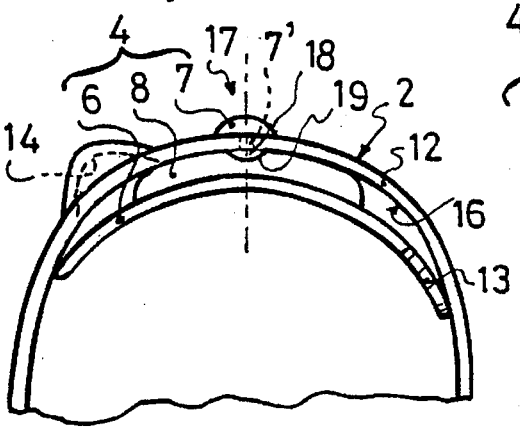
FIGS. 3 and 4 show details relating to the construction of the boot immobilization device in FIG. 1, FIG. 3 being a partial, raised view of the inside of the boot upper and FIG. 4, a partial view of the top of the upper.
Figure 3:
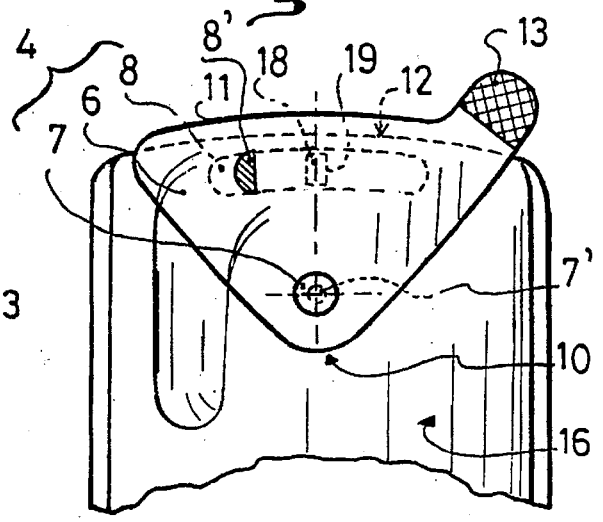
Figure 8:
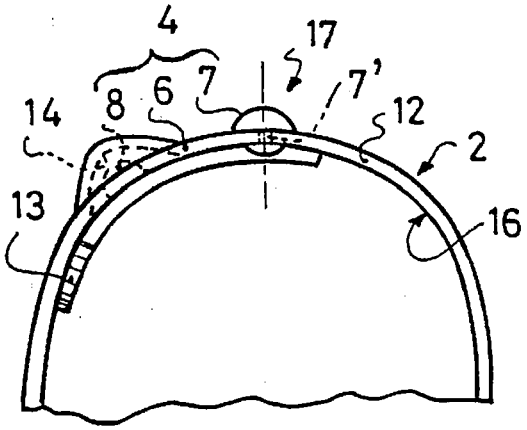
Figure 7:
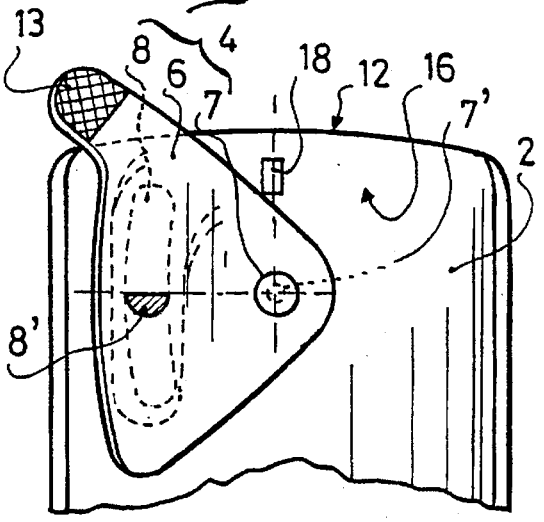

As regards the use of the immobilization device 4 to provide proper adaptation to the morphology of the skier's lower leg 9 and/or to potentially bring about a correction in the value of the angle of inclination of the lower leg 9 in relation to the shell base 1, the shim 6 and the projection 8 are preferably made thin and produced from a relatively flexible material such as plastic, in order to match as closely as possible the form and contour of the part of the upper 2 in which it is mounted, thereby ensuring continuity of surface covering the lower leg 9. Accordingly, there is no risk of oxidation damage or of dirt accumulation, for example; in addition, any dirt that may penetrate between the shim 6 and the inner wall 16 of the upper 2 is automatically swept away when the shim 6 moves in rotation. Moreover, this flexibility ensures the automatic retraction of the projection 8 into the recess 14 when they are positioned facing each other, and, therefore, the elastic retention of the shim 6 in this angled position. Furthermore, the flexibility of the shim 6 also facilitates the provision of a boss 18/recess 19 interlocking system between the inner wall 16 of the upper 2 and the projection 8, as illustrated in FIGS. 3 and 4. In this way, the shim 6 is also held in place elastically in its second angled immobilization position. Obviously, the interlocking system can be reversed: that is, the boss 18 can be provided on the rotating shim 6 or the projection 8 belonging to it, and the recess 19, in the upper 2.

To facilitate operation of the rotating shim 6 in either of its angled immobilization positions, a tongue 13 forms a lateral, upward extension of the shim 6 extending beyond the upper edge 12 of the upper 2. Thus, whether the rotating shim 6 is in the maximum or minimum angled immobilization adjustment position (see, in particular, FIGS. 1 to 3 and FIGS. 5 to 7), the tongue 13 remains accessible from the outside of the boot upper 2.

The immobilization device 4 just described with reference to FIGS. 1 to 8 is illustrated, by virtue of example, in order to provide proper adjustment to the morphology of the rear part of the lower leg 9, e.g., the skier's calf. As illustrated, the angular position of the median longitudinal axis 20 of the lower leg 9 in relation to the shell base 1 has not been modified and/or corrected using the immobilization device 4. The latter has simply readjusted the sock 5 against the lower leg 9, as shown by the arrow 22, while in fact modifying the length of a portion of the periphery of the upper 2, whose tightening adjustment has not been changed, this tightening adjustment being effected using tightening devices which act on the rear part of the lower leg 9.

This being the case, it is obvious that adjustment to match the morphology of the lower leg 9 can also be performed by changing only the tightening adjustment of the upper 2 on the front part of the lower leg 9.

In this case, the immobilization device is placed in the minimum angled immobilization position, thereby causing the tightening adjustment of the upper 2 to move the lower leg 9 backward, a motion which straightens the median longitudinal axis 20 thereof in relation to the shell base 1. The immobilization device 4 used in this way thus produces adjustment of the forward attitude.

Figure 9:
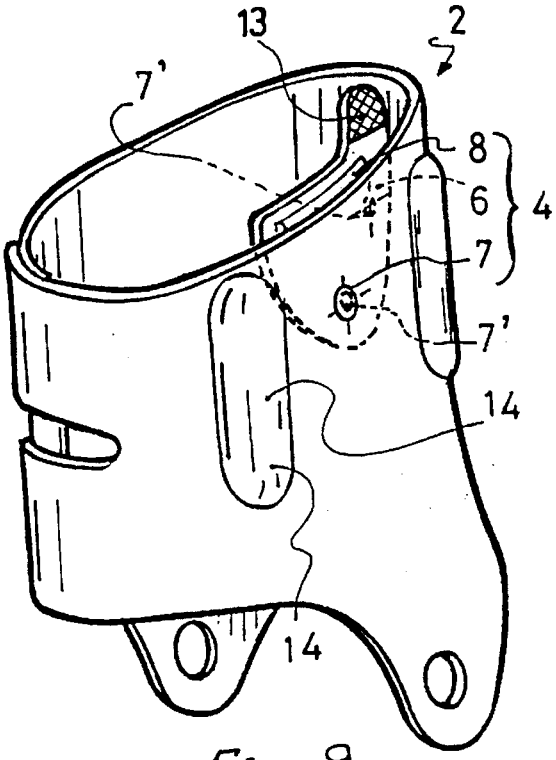
FIGS. 9 and 10 illustrate the attachment of an immobilization device similar to that in FIGS. 1 to 8, but placed on one of the lateral parts of the boot upper.
Figure 10:
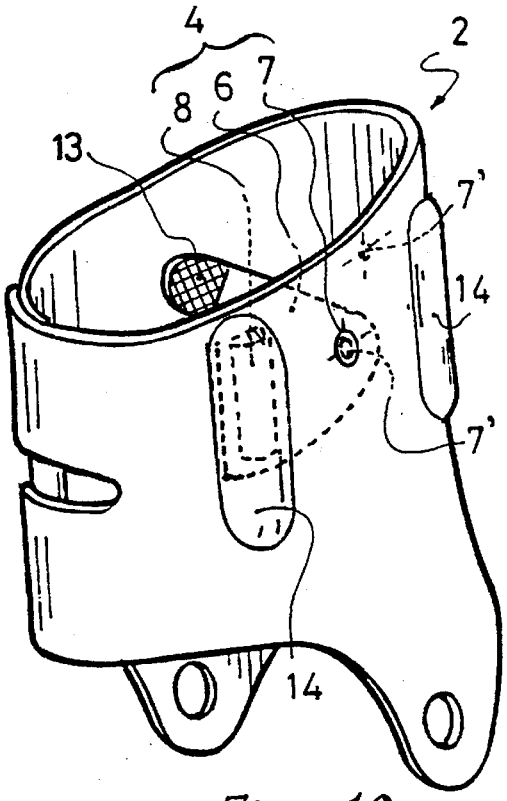

In the example just described with reference to FIGS. 1 to 8, the immobilization device 4 is positioned on the rear portion of the boot upper 2, so as to adjust the upper 2 more especially to fit the rear part of the lower leg 9, e.g., the skier's calf. It will be understood that the immobilization device 4 may also be located on the lateral portions of the boot upper 2, as illustrated schematically ill FIGS. 9 and 10. Additionally, the boot upper 2 may incorporate at least two positions for mounting the immobilization device. In this construction, the upper 2 comprises as many recesses 14 and points of attachment 7' of the pin 7 as there are mounting positions.

Figure 11:
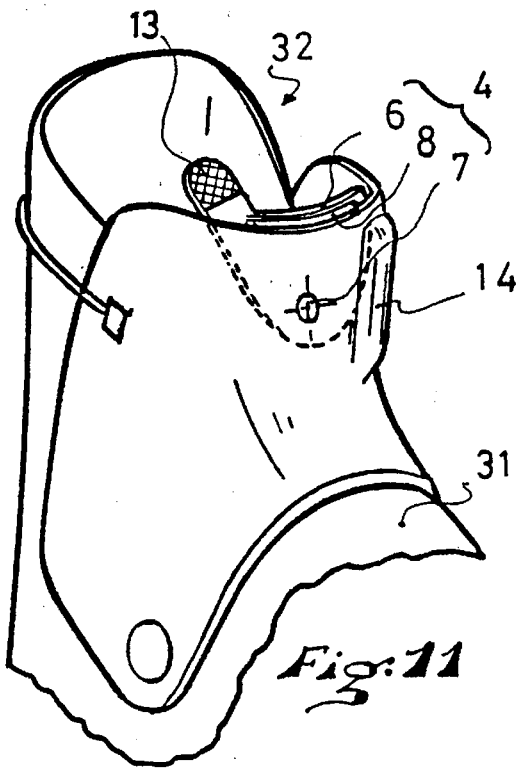
FIGS. 11 and 12 illustrate the use of the immobilization device on the rear part of the upper of a rear-entry ski boot.
Figure 12:
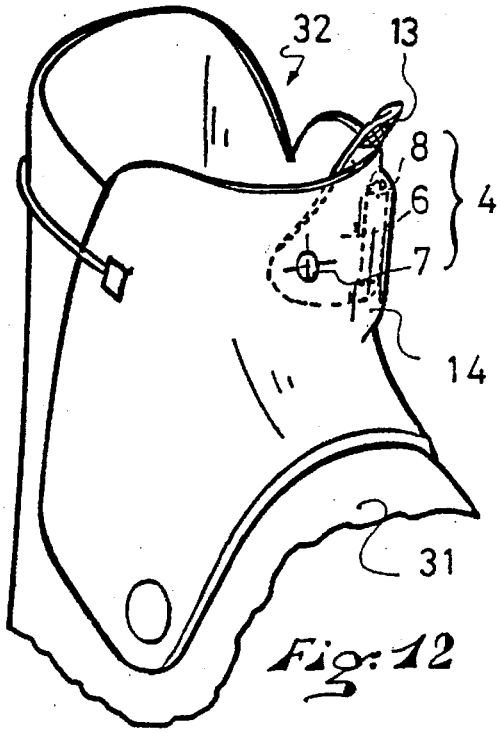

Moreover, as shown in FIGS. 11 and 12, the adjustment device 4 may adapted to the upper 32 of a rear-entry ski boot. In this type of boot, tightening adjustment is effected by means of the rear part, or rear cover, of the upper 32, which is drawn relatively close to the front part, or collar.

Finally, the immobilization device 4 may advantageously be made detachable, for example by making the connection/rotation pin 7 thereof removable from its point of attachment 7', in order to allow adjustment "at the request" of the skier or to facilitate the replacement of the rotating shim 6 by a shim possessing a range of adjustment relatively larger than the predetermined "standard" one; that is, the projection 8 may protrude very little or to a pronounced degree. Thus, depending on the height of the projection 8, the change of angular position of the shim 6 produces a relatively pronounced variation of the relative position of this shim 6 in relation to the inner wall 16 of the upper 2.

It is clear that the shim 6 belonging to the immobilization device 4 may comprise an extension piece which extends along the skier's lower leg 9 beyond the projection 8 and which, when the shim 6 is in the maximum angled immobilization position, extends beyond the upper edge 12 of the upper 2. The shim 6 thus produced and positioned angularly then forms the equivalent of a reinforced support device for the lower leg 9, which simultaneously effects the immobilization adjustment itself.

What is claimed is:

1. Sport boot incorporating a shell base surmounted by a high upper adjustable on the wearer's lower leg (9) by means of tightening devices, and comprising a device (4) for immobilization of the lower leg in and in relation to said upper by virtue of being interposed between the latter and the lower leg, wherein the immobilization device (4) comprises a rotating shim (6) which, when fastened to the upper (2) by means of a rotating connection pin (7), extends in proximity to the upper edge (12) of the upper (2, 32), and at least partially on the inner wall (16) of said upper, and is adjustable angularly in at least two positions, one of maximum immobilization and the other of minimum immobilization, and the rotating shim (6) is provided with a projection (8) which protrudes against the inner wall (16) of the upper (2) in the maximum angled immobilization position, and which retracts into a corresponding recess (14) in the upper (2) in the minimum angled immobilization position.

2. Sport boot according to claim 1, wherein the projection (8) belonging to the rotating shim (6) and the corresponding recess (14) in the upper (2, 32) are positioned at the same distance from the rotating pin (7) of the rotating shim (6), the recess (14) being offset angularly in relation to the upper edge (12) by an angle corresponding to the angle of rotation of the shim (6) between the two immobilization positions thereof.

3. Sport boot according to claim 2, wherein the shim (6) is a plate produced from a relatively flexible material, which matches the profile of the inner surface (16) of the upper (2, 32) and ensures continuity of the covering surface of the latter.

4. Sport boot according to claim 2, wherein the rotating shim (6) is detachable from the boot upper (2, 32).

5. Sport boot according to claim 4, wherein the rotating connection pin (7) of the rotating shim (6) can be detached and attached at one of several points of attachment (7') on the upper (2, 32).

6. Sport boot according to claim 2, wherein the rotating shim (6) is provided with an operating mechanism (13) accessible from the outside of the upper (2, 32) to adjust to at least the two angled immobilization positions.

7. Sport boot according to claim 2, wherein an elastic boss (18)/recess (19) interlocking system is provided between the inner wall (16) of the upper (2, 32) and the projection (8) on the rotating shim (6).

8. Sport boot according to claim 2, wherein the rotating shim (6) comprises an extension piece which extends beyond the upper edge (12) of the upper (2, 32) and which constitutes a reinforcing support device for the skier's lower leg (9).

* * * * *